United States Patent [19]

Cohen

[11] 4,306,279

[45] Dec. 15, 1981

[54] ADJUSTABLE RECESSED ELECTRICAL LIGHTING FIXTURE

[75] Inventor: Joel S. Cohen, Oakland, Calif.

[73] Assignee: U.S. Industries, Inc., New York, N.Y.

[21] Appl. No.: 56,015

[22] Filed: Jul. 9, 1979

[51] Int. Cl.[3] ..... F21V 21/28; F21V 21/30

[52] U.S. Cl. ..... 362/365; 362/269; 362/271; 362/272; 362/275; 362/428

[58] Field of Search ..... 362/35, 39, 40, 102, 362/119, 120, 177, 269, 271, 272, 282, 283, 286, 322, 371, 428, 804, 406, 365, 370, 147, 275

[56] References Cited

U.S. PATENT DOCUMENTS

| | | | |
|---|---|---|---|
| 917,137 | 4/1909 | Robinson | 362/35 |
| 1,194,135 | 8/1916 | Brown | 362/35 |
| 1,622,895 | 3/1927 | Wiemann | 362/40 |
| 2,548,154 | 4/1951 | Gosswiller | 362/272 |
| 2,649,535 | 8/1953 | Feder | 362/275 |
| 2,654,830 | 10/1953 | Runge | 362/269 |
| 2,823,366 | 2/1958 | Schmitz | 362/271 |
| 3,134,129 | 5/1964 | Allen | 362/102 |
| 3,185,832 | 5/1965 | Nagamori | 362/120 |
| 3,551,033 | 12/1970 | Beesley | 362/322 |
| 3,614,415 | 10/1971 | Edelman | 362/119 |
| 4,104,709 | 8/1978 | Kloots | 362/804 |
| 4,146,919 | 3/1979 | Jennings | 362/35 |
| 4,232,361 | 11/1980 | Kelsall | 362/269 |

*Primary Examiner*—Richard E. Schafer
*Assistant Examiner*—Edward F. Miles
*Attorney, Agent, or Firm*—Bielen and Peterson

[57] ABSTRACT

An adjustable recessed electrical lighting fixture utilizing an electrical socket which engages a lamp. A mounting plate surrounds at least a portion of the lamp. A frame having a pair of legs pivotally connects the mounting plate and provides support for the electrical socket. The frame is pivoted in relation to the mounting plate to provide adjustment about a horizontal axis. A race which contacts at least a portion of the mounting plate is movable in relation to the mounting plate to provide adjustment about a vertical axis.

18 Claims, 15 Drawing Figures

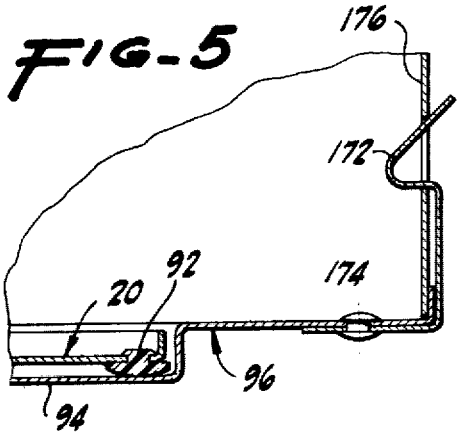
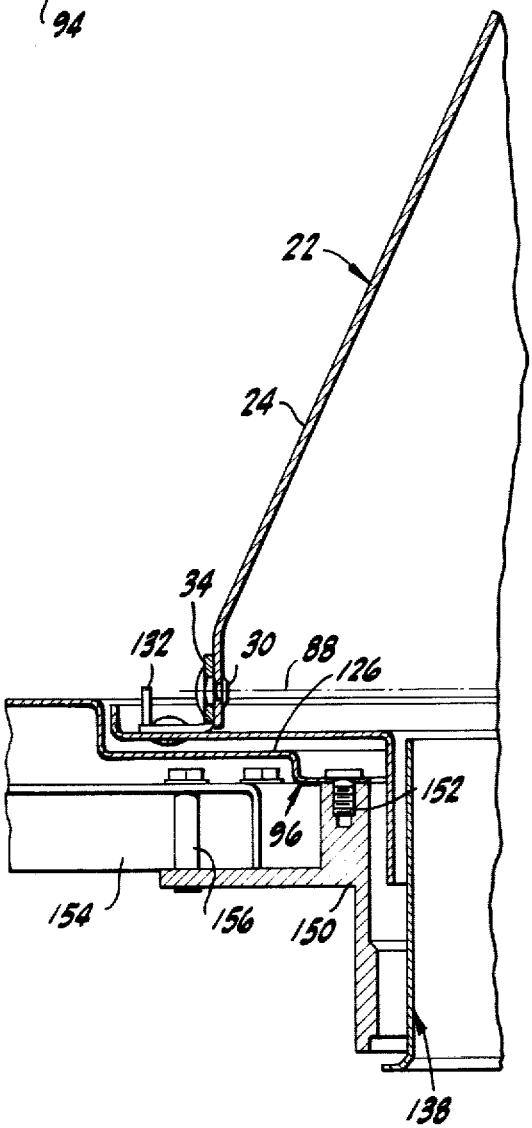
FIG-3
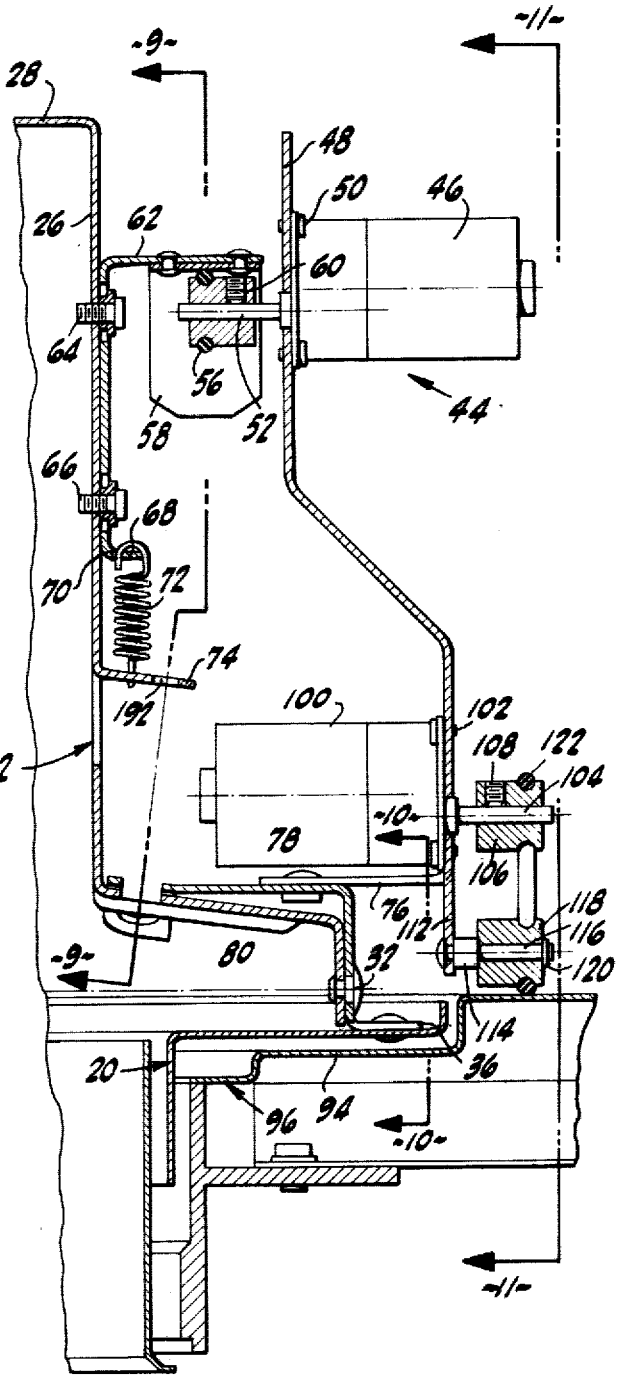
FIG-4

ADJUSTABLE RECESSED ELECTRICAL LIGHTING FIXTURE

BACKGROUND OF THE INVENTION

The present invention relates to a novel and useful adjustable recessed electrical lighting fixture for a lamp.

Modern lighting systems often include the so-called recessed or semi-recessed lighting elements. Generally recessed down lights include a reflector or baffle for producing a concentrated beam of light directed to a particular area normally directly beneath the lighting fixture. Often the direction of the beam of light must be altered to highlight and accent objects or areas within a structure.

Prior recessed lighting fixtures have been very difficult to adjust. For example, prior devices require the removal of the lamp or bulb before effecting the necessary adjustment in the light beam. Often this process must be repeated several times to obtain the correct light distribution. Each minor adjustment of the lighting fixture requires removal and replacement of the lamp, a time consuming process. For example, lighting fixture model number 1240-175MV manufactured by Prescolite, San Leandro, California requires performance of the steps hereinabove enumerated.

There is a lighting industry need for a fully adjustable recessed lighting fixture which may be automatically or manually controlled.

SUMMARY OF THE INVENTION

In accordance with the present invention an adjustable recessed electrical lighting fixture having an electrical socket and lamp is provided.

The fixture of the present invention includes a mounting plate or rotor which surrounds at least a portion of the lamp. In some embodiments the mounting plate may completely surround the lamp. A frame or yoke having a pair of legs pivotally connects to the mounting plate. In other words, each leg of the frame pivotally connects to a portion of the mounting plate. The frame supports the socket and lamp between the aforementioned pivotal connections. Thus, the fixture of the present invention is provided freedom of movement about a first axis.

The frame further encompasses means for pivoting the same in relation to the mounting plate. Such means may take the form of a track which is fixed to the frame, and means for frictionally engaging the track. Such means may include a wheel, sprocket, or the like. In addition, the pivoting means would include means for moving the means for frictionally engaging the track in relation to the track itself. Thus, the frame pivots about a first axis as desired. The means for frictionally engaging the track may be motivated by an electric motor having a remote control. Moreover, the means for pivoting the frame may take the form of a manually operable mechanism. In such a case, an elongated member would be structured to engage the frame. The elongated member may be grasped and employed to tilt or pivot the frame as desired. Such an elongated member may also be constructed to move in and out of the recess such that is visible only during adjustment of the frame. The adjustable frame may include a stop mechanism for limiting its pivotal motion.

The device of the present invention may further include adjustment of the fixture around a second axis generally at right angles to the first axis. Such a feature would entail a race which contacts at least a portion of the mounting plate and is movable in relation to the mounting plate. In certain configurations the mounting plate and race may be constructed as circular members supported by a plurality of skids or bearings. Again, means provides relative movement between the race and mounting plate and may take the form of a manual or motorized version. The motorized version may include a member connected to the rotor which frictionally engages a race and means for moving the frictionally engaging member such as an electrical motor with remote control. The elongated member, heretofore described in relation to the pivoting of the frame, may also be employed to provide relative movement between the mounting plate and the race.

The lighting fixture of the present invention may also include reflectors or baffles as needed to concentrate the beam of light emanating from the socket mounted lamp.

It may be apparent that a novel and useful adjustable recessed lighting fixture has been described.

It is therefore an object of the present invention to provide an adjustable recessed electrical lighting fixture which is adjustable about two axes generally perpendicular to one another.

It is another object of the present invention to provide an adjustable recessed electrical lighting fixture which may be remotely controlled and employs motorized means for effecting adjustment of the beam of light emanating from a lamp.

It is yet another object of the invention to provide an adjustable recessed electrical lighting fixture which is manually adjustable about a pair of axes substantially perpendicular to one another.

It is still another object of the present invention to provide an adjustable recessed electrical lighting fixture which may be adjustable by motorized or manual means without removal of the lamp from the socket of the fixture.

Another object of the present invention is to provide an adjustable recessed electrical lighting fixture which is compatible with lamps which are currently being manufactured for employment in known fixtures.

The invention possesses other objects and advantages especially as concerns particular features and characteristics thereof, which will become apparent as the specification continues.

BRIEF DESCRIPTION OF THE DRAWINGS

FIG. 3 is a sectional view taken along line 3—3 of FIG. 2.

FIG. 4 is a sectional view taken along line 4—4 of FIG. 2.

FIG. 5 is a sectional view taken along line 5—5 of FIG. 2.

Figure 1:
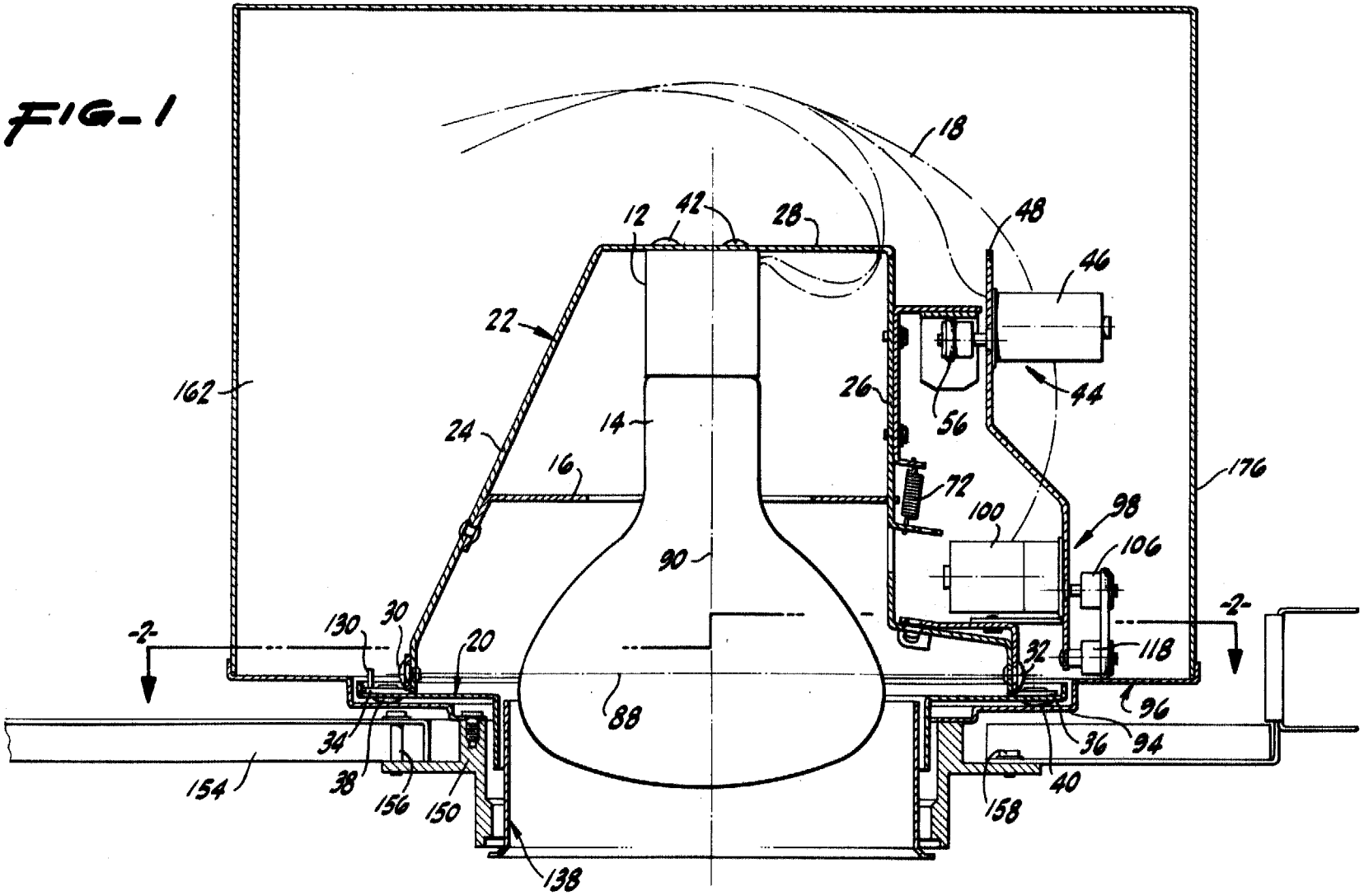
FIG. 1 is a cross-sectional view of a motorized version of the present invention.

For a better understanding of the invention reference is made to the following detailed description.

DESCRIPTION OF THE PREFERRED EMBODIMENTS

Various aspects of the present invention will evolve from the following detailed description of the preferred embodiments thereof which should be taken in conjunction with the heretofore described drawings.

The invention as a whole, which is described in the drawings, is identified by reference character 10. The fixture 10 is anticipated for use with an electrical socket 12 which electrically contacts and holds lamp 14. Plate 16 may be used in conjunction with lamp 14 if necessary, however plate 16 is not essential to the present invention. Electrical wires 18 carry electrical power from a source of electricity.

Figure 2:
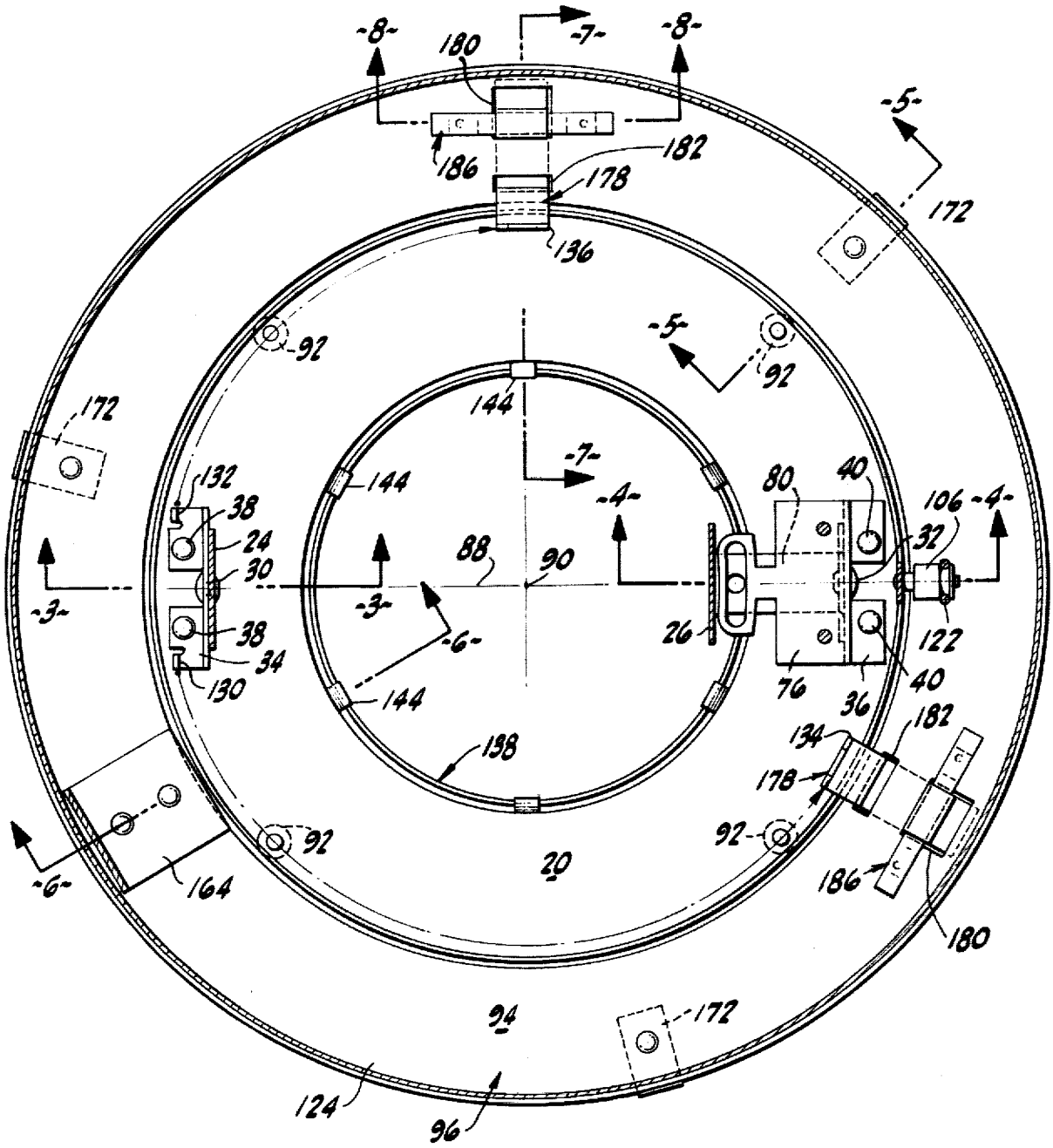
FIG. 2 is a sectional view taken along line 2—2 of FIG. 1.

Mounting plate or rotor 20 surrounds at least a portion of lamp 14, FIGS. 1 and 2. A frame member or yoke 22 includes a pair of legs 24 and 26 which are spanned by a horizontal member 28. Legs 24 and 26 pivotally connect to mounting plate 20 at pivots 30 and locking pivot 32 respectively. Specifically, brackets 34 and 36 are fixed to mounting plate 20 with rivets 38 and 40. Brackets 34 and 36 also pivotally connect to legs 24 and 26 at the heretofore described pivots 30 and 32. Socket 12 and lamp 14 are supported by horizontal member 28 of yoke 22 by fastening means 42.

Figure 9:
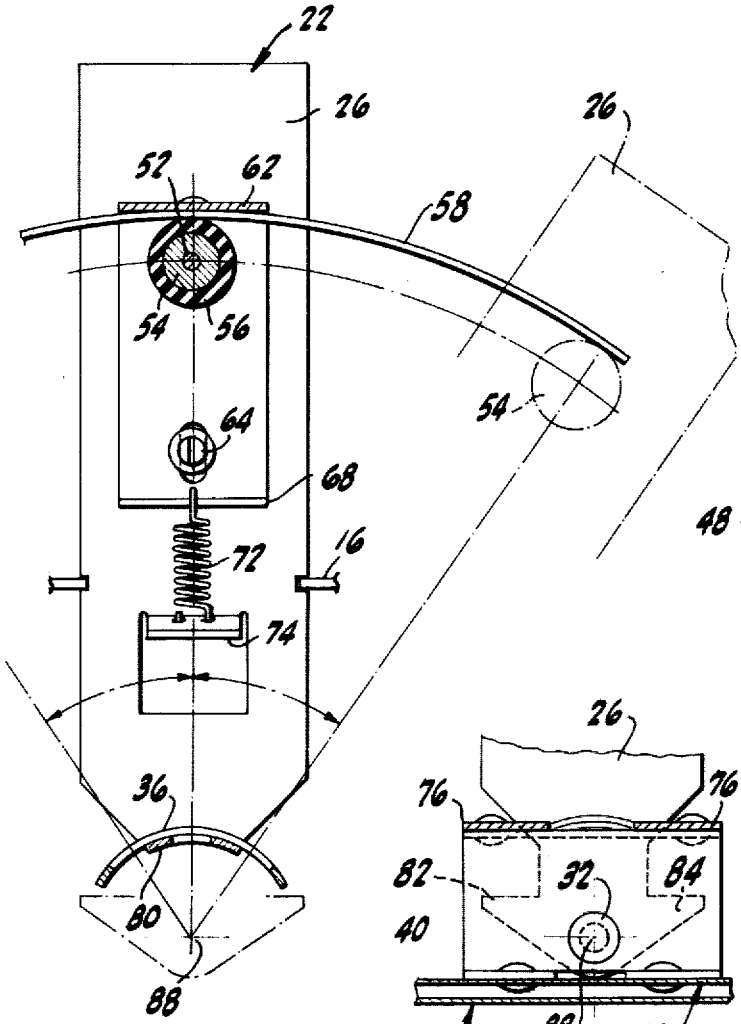
FIG. 9 is a sectional view taken along line 9—9 of FIG. 4.
Figure 11:
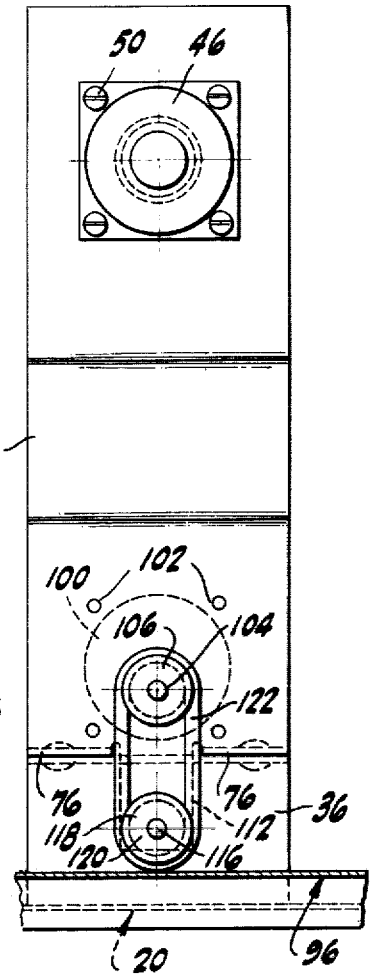
FIG. 11 is a sectional view taken along line 11—11 of FIG. 4.

The mechanism of the present invention also includes means 44 for pivoting frame 22 in relation to mounting plate 20. As depicted on FIG. 1 means 44 may take the form of a reversible D.C. electrical motor such as one manufactured by International Components Corp., Model No. 2932-150B, FIGS. 4 and 11. Motor 46 mounts to bracket 48 via mounting means 50 which may take the form of set screws, bolts and nuts, nails, and the like. Bracket 48 permits the passage of shaft 52 of electrical motor 46 therethrough. Roller 54 at the terminus of shaft 52 includes a ring 56 which frictionally engages track 58. Set screw 60 holds roller 54 snuggly to shaft 52 during rotation thereof. Track 58 mounts to bracket member 62 which essentially fixes to leg 26 of frame 22 by the use of guide pins 64 and 66, FIG. 4. Lip 68 of bracket member 62 includes an opening 70 which serves to fasten one end of spring 72. Spring 72 also fastens to flange 74 which is essentially integral with leg 26 and frame 22. Spring 72 insures the frictional engagement of ring 56 with track 58 which causes the pivoting of frame or yoke 22, FIG. 9 (phantom position of leg 26 depicted).

Figure 10:
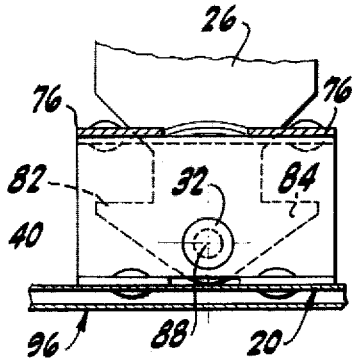
FIG. 10 is a sectional view taken along line 10—10 of FIG. 4.

Bracket 36 fixes to motor support 76 by way of fastening means 78. It should be noted that there is relative movement between bracket 36 and the lower portion 80 of leg 26, FIG. 9. Ears 82 and 84, FIG. 10, serve as means 86 for limiting the pivoting of frame 22. It should be apparent that ears 82 and 84 contact mounting plate 20 on either side of horizontal axis 88, FIG. 10.

Mounting plate 20 and frame member 22 also rotate about vertical axis 90 where a plurality of skids 92, FIGS. 1 and 5 contact a race or pan 94 which is part of member 96. Thus, race 94 contacts at least a portion of mounting plate 20 via skids 92 which may be constructed of self lubricating material such as Teflon, Kel-f, and the like. In other words, mounting plate 20 is movable in relation to race 94. The embodiments shown in the figures also includes means 98 for moving mounting plate 20 in relation to race 94. Means 98 may take the form of a motorized embodiment depicted in FIGS. 1, 2, 4, and 11. Means 98 includes a reversible electrical motor 100 similar in construction to electrical motor 46. Motor 100 nests on motor support 76 which is fixed to bracket 48 by fastening means 102, most clearly shown in FIGS. 4 and 11. Shaft 104 of motor 100 extends through bracket 48 and terminates in a roller 106 fixed to shaft 104 by set screw 108. A lower portion 112 of bracket 48 includes a bearing 114 holding a slave shaft 116. Another roller 118 is mounted on shaft 116 and held thereto by retainer 120. Ring 122 tightly fits over rollers 106 and 118. Ring 122 rests on surface 124 which is an extension of pan 94 but may be any surface free of mounting plate 20 and frame member 22. As shown in FIG. 2, ring 122 rolls on surface 124 in a generally circular pattern about vertical axis 90. In general, mounting plate 20 and race 94 have surfaces 124 and 126 which are in opposition to one another and at least partially surround lamp 14. The embodiment shown in the drawings illustrates mounting plate 20 and race 94 as completely surrounding lamp 14. With reference to FIG. 2 it should be noted that the embodiment shown further includes means 128 for limiting relative movement between race 94 and mounting plate 20. Such limiting means 128 may embrace a movable pair of stops 130 and 132 fixed or formed integrally with bracket 34. Movable stops 130 and 132 abutt stationary stops 134 and 136 found at the inner periphery of surface 124, FIGS. 1, 2, and 3. Although the embodiment shown in FIG. 2 limits the movement of means 98 to about 240°. It should be understood that his is no way deemed to be a limitation. It should be further pointed out that stationary stops 134 and 136 are identical in construction.

Figure 13:
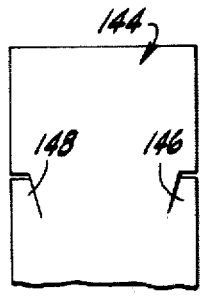
FIG. 13 is a sectional view taken along line 13—13 of FIG. 12.
Figure 12:
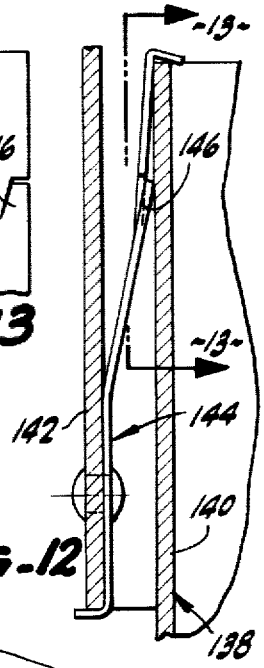
FIG. 12 is a sectional view showing the baffle retainer of the present invention.
Figure 7:
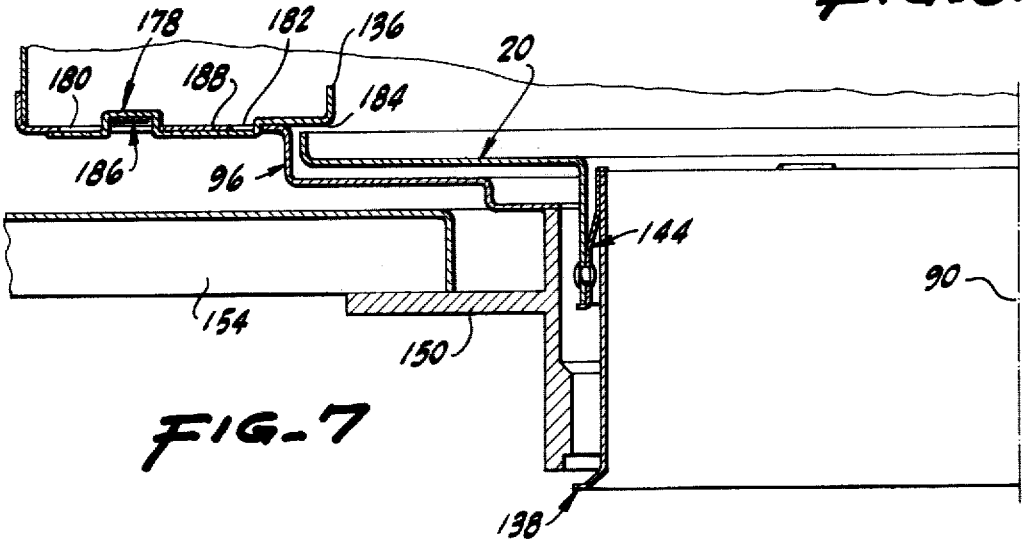
FIG. 7 is a sectional view taken along line 7—7 of FIG. 2.

A baffle 138 connects to mounting plate 20 and is therefore movable therewith. Baffle 138 extends from mounting plate 20 beyond the lower portion of the lamp. In this regard, the application of mechanism 10 may be deemed to include recessed or semi-recessed lighting fixtures. With reference to FIGS. 7, 12, and 13, it may be seen that baffle 138 includes a hollow cylindrical member 140 which is held to lower portion 142 of mounting plate 20 by a multiplicity of clips 144, clearly shown in FIGS. 12 and 13. Clip 144 includes a pair of split portions 146 and 148 which provide a gripping edge necessary to the workability of clip 144.

Turning to FIG. 3, it may be seen that member 96 fixes to support element 150 via fastening means 152. Support element 150 gains additional support to surface 154 by dint of fasteners 156 and 158.

Figure 6:
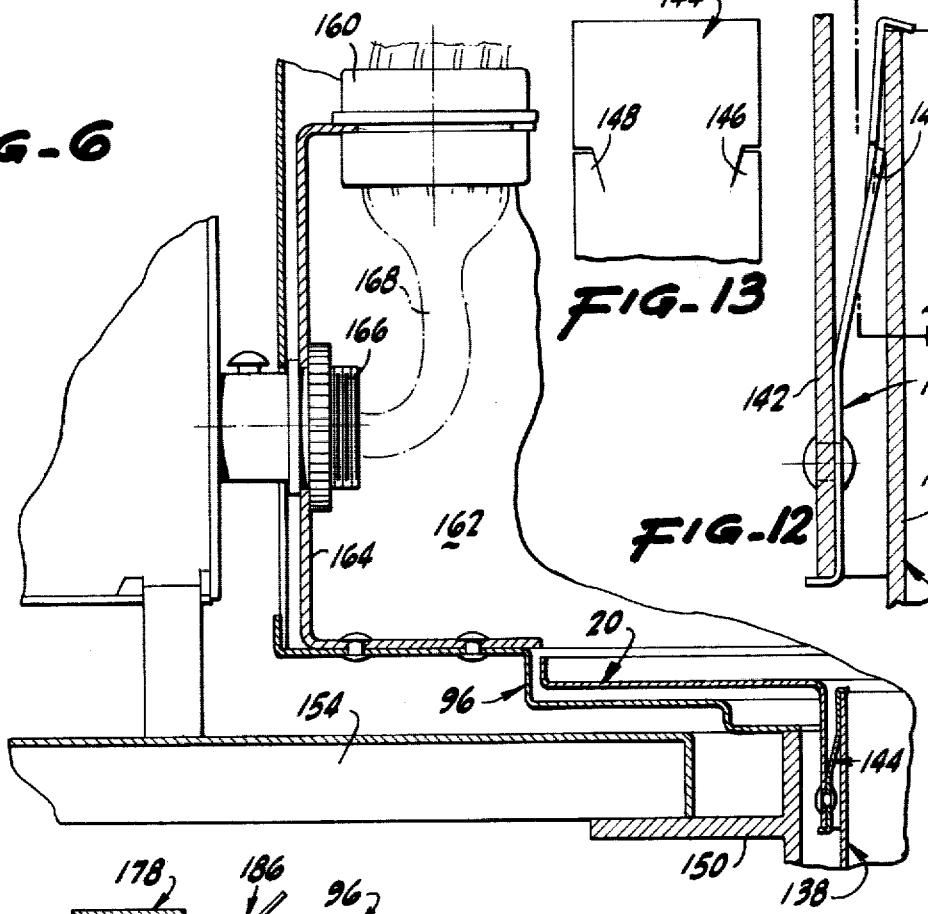
FIG. 6 is a sectional view taken along line 6—6 of FIG. 2.

With reference to FIG. 6 it may be seen that the necessary power element such as plug disconnect 160 are held within space 162 by bracket 164. Bracket 164 includes a pipe member 166 which funnels wires 168 to the exterior of space 162 for connection to the necessary power element such as a transformer and the like. It should be noted that the motorized version shown in FIG. 1 of the present invention 10 may include a remote control unit 170 (shown schematically in block form)

which may be placed within reach of a user at a desired distance from the fixture 10. Such remote control unit 170 may include an on-off switch, and means for moving motors 46 and 100 in either direction. Such remote control units 170 are known in the art and will not be further discussed herein. It should be noted that mounting bracket 164 is located in a sector of surface 124 so as not to interfere with the movement of means 98 about axis 90.

FIG. 5 shows the construction of spring clip 172 which is fastened to member 96 with rivet 174. Thus, member 96 may be pulled free of structure 176 forming space 162 therewithin.

Figure 8:
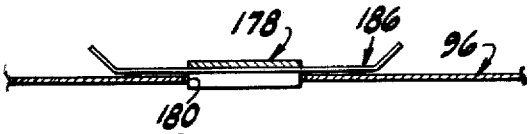
FIG. 8 is a sectional view taken along line 8—8 of FIG. 2.
Figure 8A:
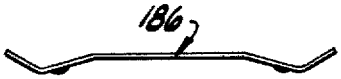
FIG. 8*a* is a side elevational view of a keeper device.

FIG. 7 depicts stationary stop 136 whereby a member 178 fits within a pair of slots 180 and 182. End portion 184 of member 178 terminates in stop 136 but also serves to retain rotor or mounting plate 20 therebelow. Member 178 may be forced away from rotor 20. Surface 188 permits the movement of ring 122 in its motion around lamp 14. FIGS. 8 and 8A depict keeper 186 in conjunction with member 178 and separated therefrom respectively.

Figure 14:
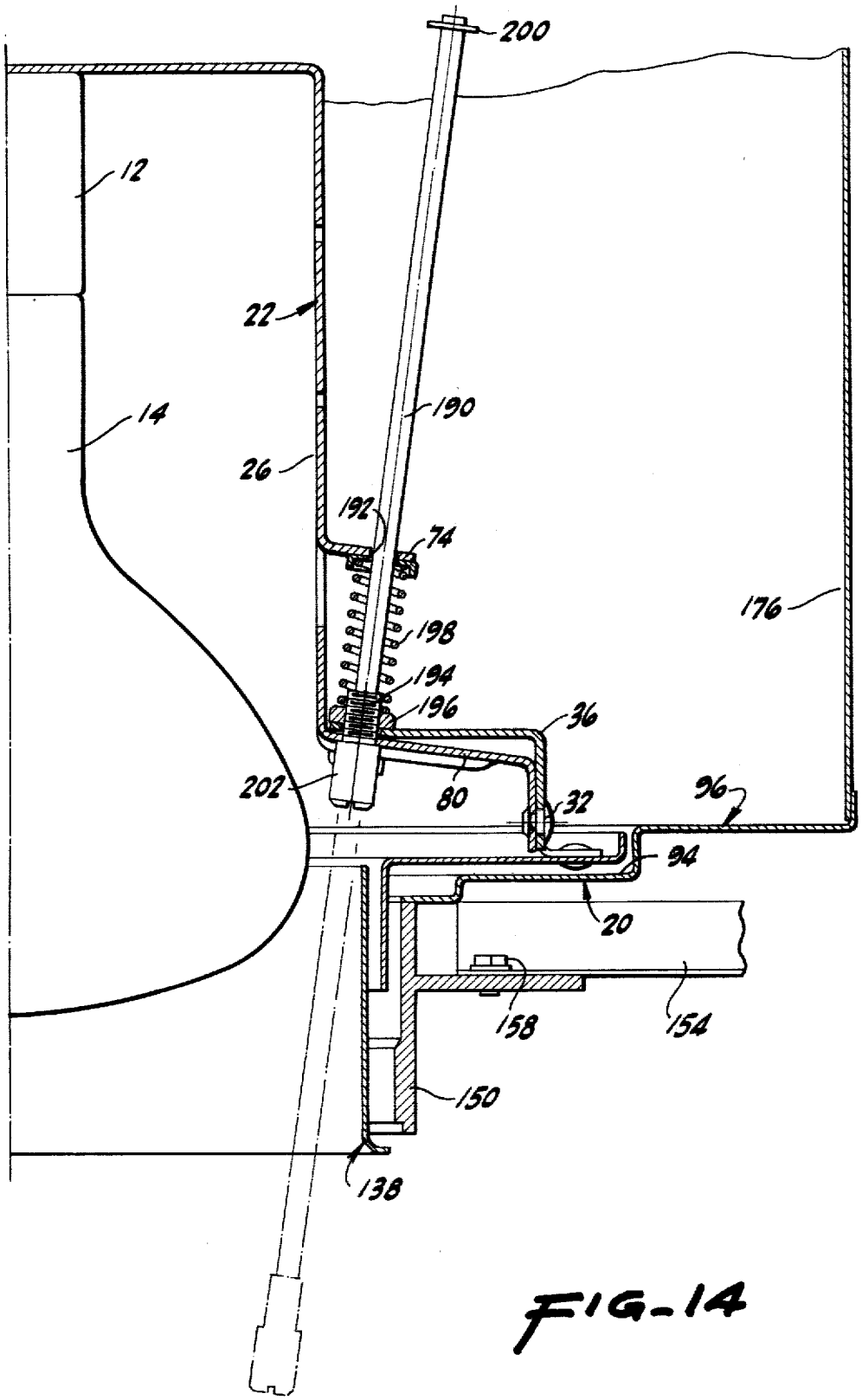
FIG. 14 is a slightly broken sectional view depicting a manually operable version of the present invention.

FIG. 14 illustrates another embodiment of the present invention which employs manual means for movement of rotor and frame about vertical axis 90 and horizontal axis 88. Such an embodiment includes an elongated member 190 which fits through opening 192 of flange 74. Member 190 includes a threaded portion 194 which threadingly engages nut 196. Spring means 198 retains nut against the upper portion of bracket 36. Washer 200 prevents passage of elongated member 190 completely through opening 192 in flange 74. Screw member 202 is continuous with threaded portion 194 and extends below the lower portion 80 of leg 26. As shown in phantom, elongated member may be lowered below the lowest point of baffle 138 to maneuver the position of lamp 14 about horizontal and vertical axes 88 and 90 which will be hereinafter described.

In operation, the user of the embodiment depicted in FIGS. 1 through 13 merely manipulates remote control unit 170 to cause rotation of mounting plate 20 in relation to race 94 to adjust the beam of light emanating from lamp 14 about vertical axis 90 through the motive force provided by reversible motor 100. Ring 122 will ride on surface 124 to provide such movement about vertical axis 90. Likewise, remote control unit 170 will activate reversing motor 46 and move ring 56 on track 58 to provide adjustments about horizontal axis 88. A combination of movements about axes 88 and 90 will permit the adjustment of lamp 14 in any direction below surface 154. Moreover, the embodiment shown in FIG. 14 operates to effectively adjust lamp 14 by disengaging threaded portion 194 of elongated member 190 from nut 196. Elongated member 190 is pulled downwardly to the vicinity of the lower edge of baffle 138. The user then applies pressure to screw portion 202 of elongated member 190 to either tilt lamp 14 on horizontal axis 88 or to rotate mounting plate and frame 22 about vertical axis 90. After use, elongated member 190 is again threaded into nut 196 until further use is necessary.

While in the foregoing specification embodiments of the present invention have been set forth in considerable detail for the purposes of making a complete disclosure of the invention, it will be apparent to those of ordinary skill in the art that numerous changes may be made in such details without departing from the spirit and principles of the invention.

I claim:

1. An adjustable recessed electrical lighting fixture having an electrical socket and lamp within a housing recessed in relation to a surface comprising:

a. a mounting plate for surrounding at least a portion of the lamp;

b. a frame being pivotally connected to said mounting plate at two points on either side of the lamp defining a first axis, the socket and lamp being supported by said frame between said pivotal connection points of said frame to said mounting plate;

c. means for pivoting said frame in relation to said mounting plate at said pivotal connection points about said first axis;

d. a race contacting at least a portion of said mounting plate, said mounting plate and race being movable in relation to one another about a second axis, said first axis substantially intersecting said second axis; and e. means for providing relative movement between said race and said mounting plate.

2. The adjustable recessed electrical lighting fixture of claim 1 in which said means for pivoting said frame about said first axis comprises:

a. a track fixed to said frame;

b. means for frictionally engaging said track;

c. means for moving said means for frictionally engaging said track in relation to said track and thereby pivoting said frame;

3. The adjustable electrical lighting fixture of claim 2 in which said track has an arcuate cross-sectional configuration.

4. The adjustable recessed electrical lighting fixture of claim 2 which additionally comprises means for limiting said pivoting of said frame.

5. The adjustable recessed electrical lighting fixture of claim 1 in which said means for providing relative movement between said race and said mounting plate comprises:

a. means for frictionally engaging a surface free of said mounting plate; and b. means for moving said means for frictionally engaging said surface.

6. The adjustable recessed electrical lighting fixture of claim 5 in which said race and said mounting plate each include a surface, said surfaces being in opposition to one another and being in at least partially surrounding disposition relative to the lamp.

7. The adjustable recessed electrical lighting fixture of claim 6 in which a plurality of skids interposed said surfaces of said race and mounting plate.

8. The adjustable recessed electrical lighting fixture of claim 7 which additionally includes means for limiting said relative movement between said race and said mounting plate.

9. The adjustable recessed electrical lighting fixture of claim 8 which additionally comprises a baffle being connected to said mounting plate and extending from said mounting plate.

10. The adjustable recessed electrical lighting fixture of claim 2 in which said means for providing relative movement between said race and said mounting plate comprises:

a. means for frictionally engaging a surface free of said mounting plate; and b. means for moving said means for frictionally engaging said surface.

11. The adjustable recessed lighting fixture of claim 10 in which said race and said mounting plate each include a surface being in opposition to one another and being in at least partially surrounding disposition relative to the lamp.

12. The adjustable recessed electrical lighting fixture of claim 11 in which a plurality of skids are interposed said surfaces of said race and mounting plate.

13. The adjustable recessed electrical lighting fixture of claim 12 which additionally includes means for limiting said relative movement between said race and said mounting plate.

14. The adjustable recessed electrical lighting fixture of claim 13 which additionally comprises a baffle being connected to said mounting plate and extending from said mounting plate beyond a dimension of the lamp.

15. The adjustable recessed electrical lighting fixture of claim 1 which additionally comprises means for remotely motivating said means for pivoting said frame and said means for providing relative movement between said race and said mounting plate.

16. The adjustable recessed electrical lighting fixture of claim 1 which additionally comprises means for permitting manual motivation of said means for pivoting said frame and motivation of said means for providing relative movement between said race and said mounting plate.

17. The adjustable recessed electrical lighting fixture of claim 16 in which said means for permitting manual motivation of said pivoting means and means for providing relative movement between said race and said mounting plate comprises an elongated member which engages said frame.

18. The adjustable recessed electrical lighting fixture of claim 17 in which said elongated member additionally comprises means for movement of at least a portion of said elongated member out of the housing.

* * * * *